US006589457B1

(12) United States Patent
Li et al.

(10) Patent No.: US 6,589,457 B1
(45) Date of Patent: Jul. 8, 2003

(54) POLYMER-ASSISTED AQUEOUS DEPOSITION OF METAL OXIDE FILMS

(75) Inventors: DeQuan Li, Los Alamos, NM (US); Quanxi Jia, Los Alamos, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 09/629,116

(22) Filed: Jul. 31, 2000

(51) Int. Cl.[7] ..... B29C 41/00; B29C 67/20; B05D 3/02; B05D 3/10; B05D 5/00

(52) U.S. Cl. ..... 264/44; 264/414; 264/415; 264/615; 264/618; 264/621; 264/624; 264/628; 264/681; 216/56; 216/97; 427/226; 427/336; 427/352; 427/243; 427/245

(58) Field of Search ..... 427/226, 336, 427/352, 243, 245; 216/56, 97; 264/615, 618, 621, 624, 628, 681, 650, 44, 414, 415

(56) References Cited

U.S. PATENT DOCUMENTS 3,990,957 A * 11/1976 Hoekje et al. ..... 204/291
4,086,649 A 4/1978 Hanold, III ..... 361/321
4,289,816 A * 9/1981 Fogelberg et al. ..... 427/226
5,137,749 A * 8/1992 Yamazaki et al. ..... 427/108
5,328,718 A 7/1994 Abe et al. ..... 427/126.3
5,368,834 A * 11/1994 Kulwicki et al. ..... 264/9
5,494,700 A * 2/1996 Anderson et al. ..... 427/115
5,540,981 A * 7/1996 Gallagher et al. ..... 257/13
5,573,798 A * 11/1996 Kato et al. ..... 204/192.1
5,637,346 A 6/1997 Moriyama et al. ..... 427/100
5,788,757 A 8/1998 Uchida et al. ..... 106/287.18
5,811,847 A 9/1998 Joshi et al. ..... 257/296
5,824,456 A 10/1998 Ogi et al. ..... 430/325
6,007,743 A * 12/1999 Asada et al. ..... 174/126.2
6,027,766 A * 2/2000 Greenberg et al. ..... 204/192.12
6,255,762 B1 * 7/2001 Sakamaki et al. ..... 29/592.1
6,261,469 B1 * 7/2001 Zakhidov et al. ..... 216/56
6,337,032 B1 * 1/2002 Chivukula et al. .... 252/62.9 PZ

OTHER PUBLICATIONS

Saha et al., "Synthesis of Nanophase PLZT (12/40/60) Powder by PVA–Solution Technique," NanoStructured Materials, vol. 8, No. 1, pp. 29–36, 1997. (no mo).

Schwartz, "Chemical Solution Deposition of Perovskite Thin Films," Chem. Mater., 1997, 9, 2325–2340 (no mo).

Lange, "Chemical Solution Routes to Single–Crystal Thin Films," Science, vol. 273, pp. 903–909, Aug. 16, 1996.

Haykashi et al., "Preparation and Properties of Ferroelectric $BaTIO_3$ Thin Films by Sol–Gel Process," Jpn. J. Appl. Phys. vol. 32, pp. 4092–4094, 1993 (no mo).

* cited by examiner

*Primary Examiner*—Shrive P. Beck
*Assistant Examiner*—Michael Cleveland
(74) *Attorney, Agent, or Firm*—Bruce H. Cottrell

(57) ABSTRACT

An organic solvent-free process for deposition of metal oxide thin films is presented. The process includes aqueous solutions of necessary metal precursors and an aqueous solution of a water-soluble polymer. After a coating operation, the resultant coating is fired at high temperatures to yield optical quality metal oxide thin films.

3 Claims, 4 Drawing Sheets

POLYMER-ASSISTED AQUEOUS DEPOSITION OF METAL OXIDE FILMS

This invention was made with government support under a contract with the Department of Energy (Contract No. W-7405-ENG-36).

FIELD OF THE INVENTION

The present invention relates to a deposition technique for metal oxide films and more particularly to the polymer assisted aqueous solution deposition of metal oxide films, especially thin metal oxide films. The present invention also relates to the preparation of metal nitride films.

BACKGROUND OF THE INVENTION

Metal oxide ceramic thin films are widely used in the electronics industry. Preparation of such metal oxide ceramic films has been accomplished by physical vapor deposition techniques, chemical vapor deposition techniques, and by chemical solution deposition techniques. Chemical solution deposition techniques have been generally viewed as less capital intensive (see, Lange, "Chemical Solution Routes to Single-Crystal Thin Films", Science, vol. 273, pp. 903–909, 1996 and Schwartz, "Chemical Solution Deposition of Perovskite Thin Films", Chem. Mater., vol. 9, pp. 2325–2340, 1997). Yet, typical chemical solution deposition techniques are carried out in an organic solvent. Organic solvents are not desirable for many industrial production lines. For example, well known sol-gel processes typically employ a metal alkoxide together with an organic solvent such as 2-methoxyethanol. The elimination of organic solvents from chemical solution deposition techniques is generally preferred when possible. Thus, continued efforts have been expended in the development of chemical solution deposition processes which can be organic solvent-free.

Another drawback of using organic solvents is their compatibility with organometallic compounds. Metal salts are typically insoluble in organic solvents. In order to make metal salts or compounds soluble in organic solvents, organic moieties have to be added to form metal complexes. This is often undesirable as new reactions and techniques must be developed to incorporate such soluble organic groups onto metal ions. The resulting organometallic compounds are usually difficult to handle because of their relatively higher reactivity than metal salts.

One common chemical solution method, a sol-gel process, uses the high reactivity of organometallic precursors and hydrolyzes these organometallic compounds to make various oligimers. These metal oxo oligimers have suitable viscosity to allow spinning into thin films, which can be fired into ceramic materials at high temperatures. The complication in such a sol-gel process is the uncontrollable polymerization of the metal oxo oligimers because of complex reactive species in the precursor solution. Therefore, the reproducibility of sol-gel processes is poor which hinders the applications in industrial processes despite the low costs.

In the processing of metal salts into metal oxides, the use of organometallic compounds as well as sol-gel techniques can be less desirable than an aqueous process. However, one problem with aqueous processing of metal salts into metal oxide thin films is the hydrolytic properties of the metal ions. Typically, metal salts such as metal nitrates or metal acetates are very soluble in water and thee metal ions undergo various degrees of hydrolysis. For example, transition metal ions, such as titanium, niobium and tantalum, react with water violently to yield metal hydroxides and a smoke-like hydrolytic side product of hydrogen chloride. This is undesirable because these transition metals may precipitate out of solution prior to further processing. Therefore, the problems of metal ion hydrolysis must be solved to allow an aqueous solution method for processing metal oxides. A more desired methodology to achieve ceramic thin films would be a chemical solution having the following properties: clean decomposition to pure ceramics; stable chemical solutions (no gelling) without any reactions before the firing stage; and, the desired viscosity for spin coatings or film casting.

U.S. Pat. No. 5,368,834 describes a method for producing a metal titanate powder such as barium strontium titanate powder by forming a solution of metal organic precursor compounds including, e.g., a titanium lactate chelate, placing the solution in a reservoir, forming a mist from the solution, entraining the droplets of the mist in a carrier stream and subjecting the droplets to a temperature of at least 700° C. for a period of time to pyrolyze the droplets into a powder of the metal titanate. The powder can then be formed into a ceramic shape by combining the powder with an organic binder, pressing into the desired shape and sintering to form the final ceramic material. There is no description of forming a film of the metal titanate directly from the solution without initially forming a powder.

An object of the present invention is to provide a chemical solution deposition method of forming metal oxide films, such a chemical solution deposition method including the deposition of a water-soluble metal complex and a water-soluble polymer.

Another object of the present invention is to provide a chemical solution deposition method of forming high purity metal oxide thin films.

Another object of the present invention is to provide a chemical solution deposition method of forming metal nitride films, such a chemical solution deposition method including the deposition of a water-soluble metal complex and a water-soluble polymer.

Yet another object of the present invention is to provide a metal oxide or metal nitride precursor solution that has a longer shelf-life time than typical sol-gel solutions as such solution to ceramic approaches offer flexibilities and convenience frequently required in manufacturing processes.

Still another object of the present invention is to provide an aqueous chemical solution deposition method of forming metal oxide films, such a method characterized as organic solvent-free.

SUMMARY OF THE INVENTION

To achieve the foregoing and other objects, and in accordance with the purposes of the present invention, as embodied and broadly described herein, the present invention provides for a process of preparing a metal oxide film including applying an aqueous solution including a water-soluble polymer and a water-soluble metal precursor onto a substrate to form a polymer and metal-containing layer thereon, treating said substrate including said polymer and metal-containing layer to form a coherent inorganic-organic composite film, and heating said substrate at temperatures characterized as sufficient to remove said polymer and form said metal oxide film.

The present invention further provides for preparation of a barium titanate thin film by deposition of an aqueous solution including barium acetate, titanium bis(ammonium lactato)dihydride and polyvinyl alcohol, followed by the drying and calcination so as to form a polymer-free barium titanate thin film. In other embodiments, ceramic films of ruthenium oxide ($RuO_2$), magnesium oxide (MgO), strontium titanate ($SrTiO_3$) and yttria-barium-copper oxide (YBCO) can be prepared.

The present invention further provides a process for preparation of a metal oxide thin film, the process characterized as organic-solvent free.

The present invention further provides a composition of matter comprising an aqueous solution of a metal compound and a water-soluble polymer. The water-soluble polymer can be selected from polyvinyl alcohol, polyethylene glycol, poly(acrylic acid), poly(diallyldimethyl ammonium chloride), and polyethylenimine.

The present invention further provides a process of preparing a metal nitride film including applying an aqueous solution including a water-soluble polymer and a water-soluble metal precursor onto a substrate to form a polymer and metal-containing layer thereon, treating said substrate including said polymer and metal-containing layer to form a coherent inorganic-organic composite film, and heating said substrate at temperatures characterized as sufficient to remove said polymer and form said metal nitride film.

DETAILED DESCRIPTION

Figure 1:
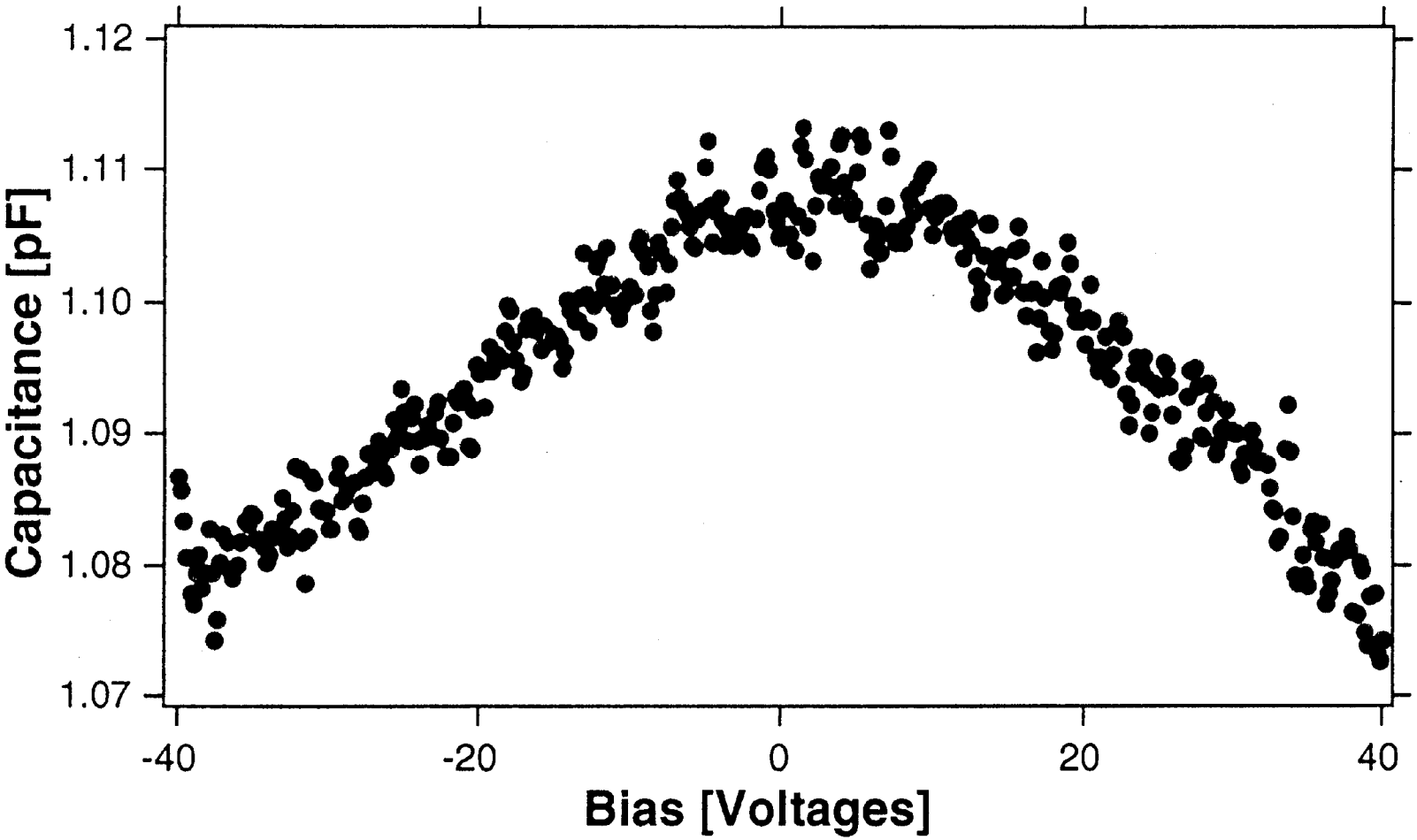
FIG. 1 shows a graph plotting bias versus capacitance for a barium titanate film formed by the process of the present invention.
Figure 2:
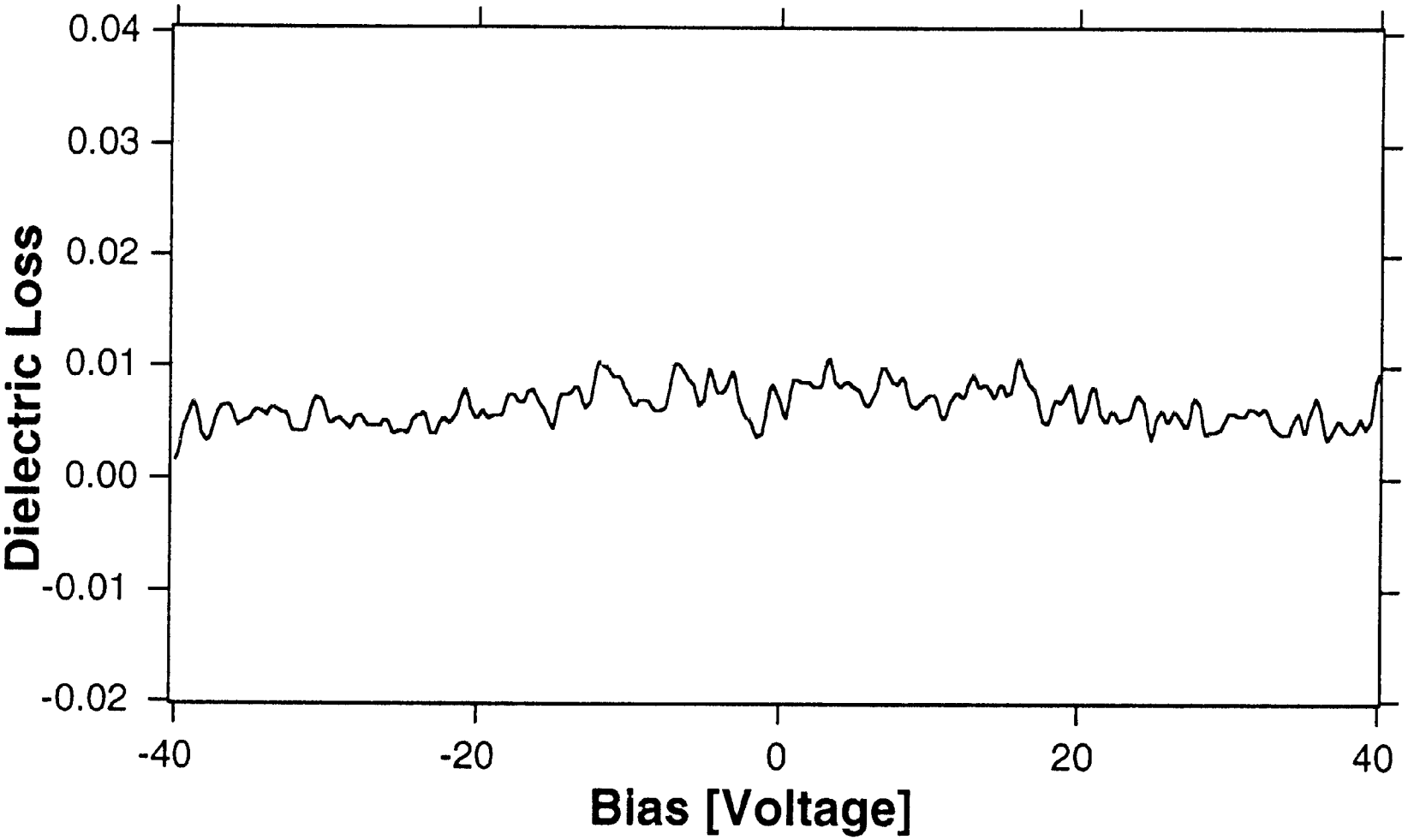
FIG. 2 demonstrates the low dielectric loss for a barium titanate film as shown by a graph plotting bias versus dielectric loss for a barium titanate film formed by the process of the present invention.
Figure 3:
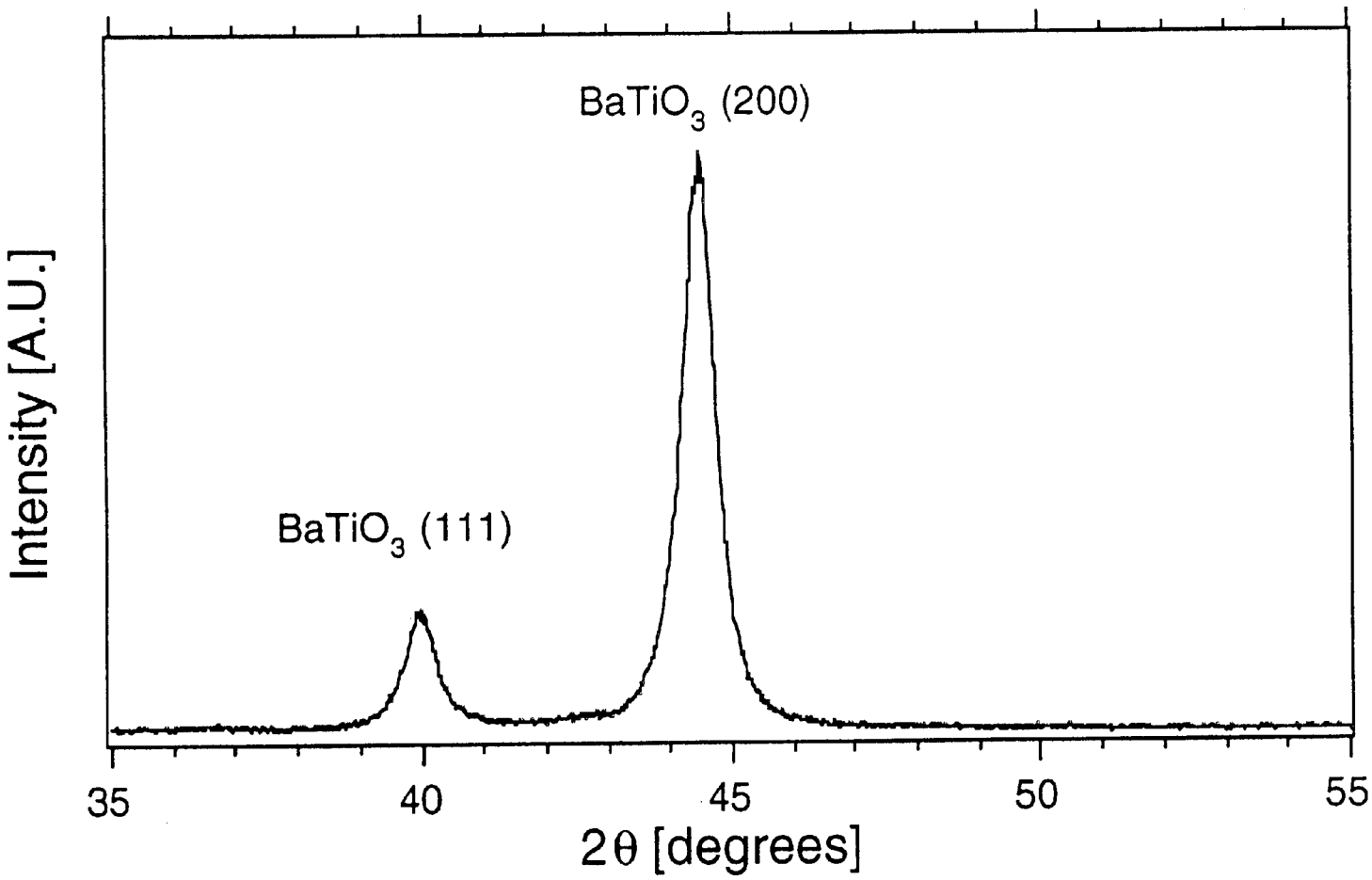
FIG. 3 demonstrates the preferential orientation achieved for a barium titanate film on a silicon oxide/silicon substrate as shown by a graph plotting intensity versus two theta for a barium titanate film formed by the process of the present invention.
Figure 4:
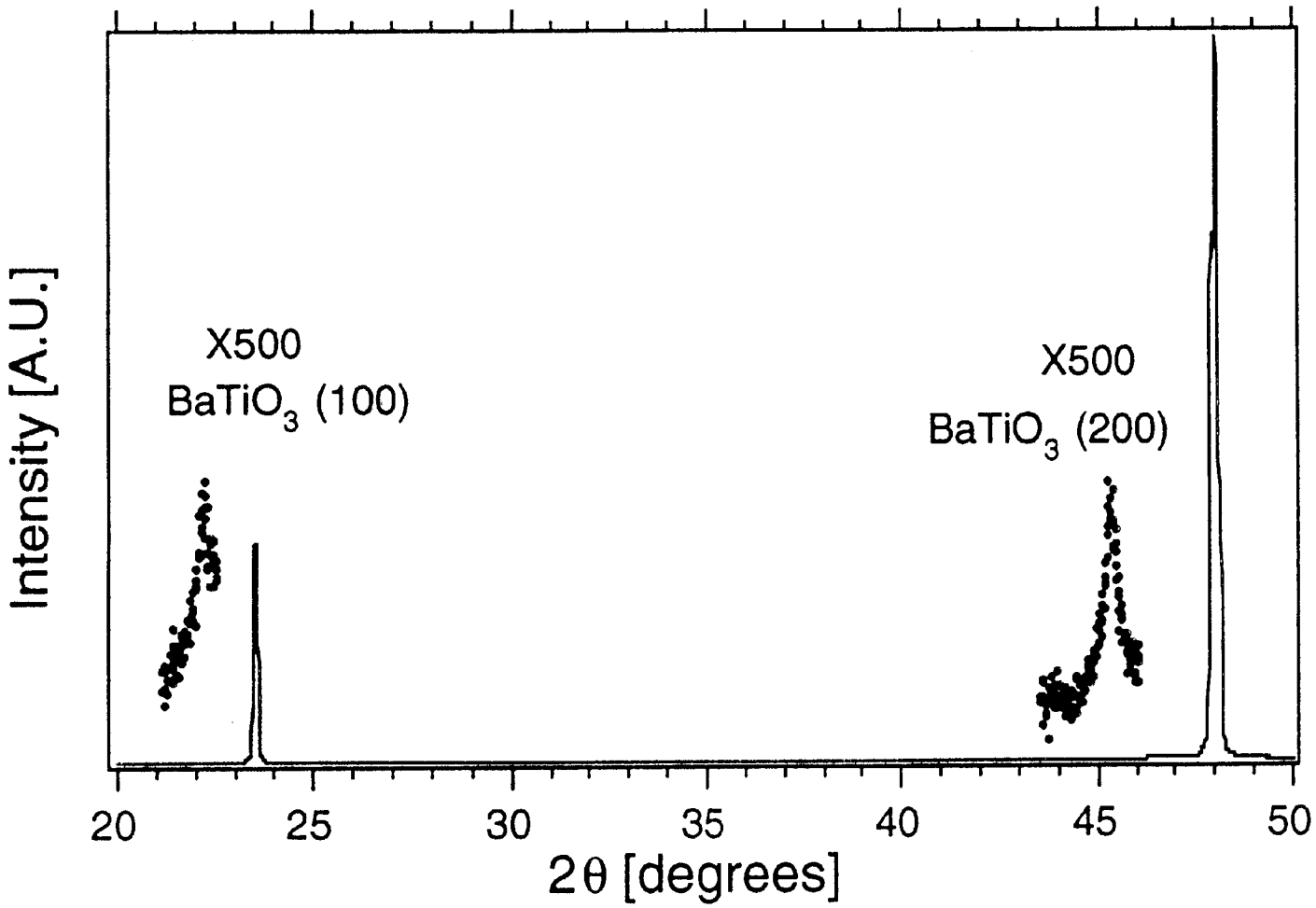
FIG. 4 demonstrates the single orientation achieved for a barium titanate film on a lanthanum aluminate substrate as shown by a graph plotting intensity versus two theta for a barium titanate film formed by the process of the present invention.

The present invention is concerned with a process for preparing metal oxide materials, such as metal oxide films, especially metal oxide thin films from aqueous solutions, preferably in an organic solvent-free process. The present invention is further concerned with a similar process for preparing metal nitride materials, such as metal nitride films, especially metal nitride thin films.

In order to process metal oxides in water, two issues must be addressed: metal ion hydrolysis and solution viscosity. In one embodiment of the present invention, the hydrolytic reactions in water are avoided by using ligands to block the access of water molecules to the metal ions. This is especially important with early transition metals such as titanium, niobium, tantalum and the like. This effectively changes the hydrolytic properties of the metal ions and makes very stable metal ion complexes in aqueous solution. For example, titanium (IV) species such as titanium chloride ($TiCl_4$) and titanium hydroxide ($Ti(OH)_4$) are typically unstable in water and will hydrolyze to form partial hydroxides or various degrees of titanium oxo compounds. However, a lactato ligand can stabilize the hydrolytic properties of titanium and in fact titanium bis(ammonium lactato)dihydroxide is stable and soluble in water.

The water-soluble metal chelates used in the present invention include, e.g., titanium bis(ammonium lactato) dihydride and the like. Titanium bis(ammonium lactato) dihydride or dihydroxybis(ammonium lactato)titanium (CAS No. 65104-06-5) as the water soluble source of titanium is sold by E. I. DuPont de Nemours and Company under the name Tyzor LA®, which contains 13.7 weight/weight percent or 16.6 weight/volume percent $TiO_2$. Several other water-soluble titanium chelates are available commercially. Similar water-soluble chelates are also available for other desired metals such as tantalum and niobium.

In order to have good processing characteristics, the metal oxide precursor solution must have a suitable viscosity. Instead of relying on uncontrollable viscosity generated by hydrolysis of metal oxo compounds, water-soluble polymers are used to yield the viscosity desired for thin film processing. While not wishing to be bound by the present explanation, it may be that in addition to providing the suitable viscosity, the water-soluble polymer also functions as a ligand thereby enhancing the solubility of the metal compounds and/or stabilizing the metal ions from hydrolysis. In an alternative embodiment, suitable viscosity can be provided by the addition of an inorganic additive such as colloidal silica or an organic additive such as a polymeric colloidal latex. Colloidal silica can also be added together with a water-soluble polymer and following the calcination of the composite whereby the polymer is removed, a silica-containing metal oxide film can be obtained. Removal of the silica by, e.g., etching with hydrofluoric acid can yield a microporous metal oxide material, e.g., film.

In the present invention metal ions are protected from hydrolysis by the introduction of ligands while a water-soluble polymer provides suitable viscosity for processing of the ceramic precursors. The criteria on the choice of polymers are that they be water soluble, have clean decomposition, i.e., no residue, and are compatible with the metal precursors, i.e., they do not precipitate or react to hinder the deposition.

The process of the present invention uses a water-soluble polymer to assist in the deposition of the desired metal oxide. Thus, the process can be referred to as a polymer assisted solution deposition process. Inclusion of a water-soluble polymer with the water-soluble metal complex or complexes promotes better distribution of the materials during the deposition. Subsequently, the polymer can be removed by heating at sufficiently high temperatures to leave the metal oxide film. The resultant film can be oriented or epitaxial in structure. By using a water-soluble polymer in conjunction with one or more water-soluble metal complexes, single or mixed metal oxide films can be prepared. The overall process is an aqueous process that can be organic solvent free.

The water-soluble polymer used in the present process can be polyvinyl alcohol or may be polyethylene glycol, polyacrylic acid, poly(diallyl ammonium chloride) or polyethylenimine. Polyvinyl alcohol is the preferred water-soluble polymer because of its low decomposition temperature. Typically, the molecular weight of such polyvinyl alcohol can be within the range of from about 9000 to about 10,000 and be about 80 percent hydrolyzed.

One important function of the water-soluble polymer is to provide necessary viscosity so that the metal oxide precursor solution can be processed into desired configurations such as thin films. The desired viscosity can be achieved through controlling the solution concentration of the water-soluble polymers. For high quality homogeneous films, polymer concentrations and the polymer ratio to metal components should be maintained at a proper balance. The rheology of the metal oxide precursor is also important for the morphology and quality of the final metal oxide films. In order to form smooth thin films, the polymer solution must have suitable rheological properties so that the spin-coated films have no undesired patterns associated with polymer rheological properties.

The polymer functions as a chaperone in assisting the formation of the polymer-metal composite and ultimately the ceramic thin films. This requires that the polymer should also have suitable interactions to metal ions such that no phase separation occurs during the deposition processes. Thereafter, the polymer-metal composite films are calcined to obtain the final metal oxide films. Thus, the water-soluble polymer selection should also have suitable decomposition characteristics, e.g., a clean decomposition under calcination conditions, so that the final metal oxide is free of side products.

The aqueous composition used for the deposition includes the water-soluble polymer and the water-soluble metal chelates. In addition, other metals can be included through addition of appropriate water-soluble metal salts. For example, barium can be added through a water-soluble barium salt such as barium acetate. Other suitable metal salts may include metal nitrates, metal nitrites, metal oxalates, metal acrylates, and metal coordination complexes.

The aqueous composition is typically maintained at ambient temperatures from about 15° C. to about 30° C., more usually from about 20° C. to about 25° C. Within those temperature ranges, the materials added to the solution are water-soluble.

The metal ratio can be controlled through appropriate addition of water-soluble metal chelates and water-soluble metal salts to the aqueous composition used for the deposition. Such aqueous compositions generally have a shelf life of more than a year.

The metal oxide films prepared by the present process can include a metal oxide with a single metal, can be a metal oxide with two metals or may be a metal oxide including three or more metals. Among the metal oxides preparable by the present process are included titanium oxide, magnesium oxide, zinc oxide, ruthenium oxide and the like. Among the mixed metal oxides preparable by the present process are included barium titanium oxide (barium titanate), strontium titanium oxide (strontium titanate), barium strontium titanium oxide (barium strontium titanate), strontium ruthenium oxide (strontium ruthenate), lanthanum-strontium manganese oxide, yttrium-barium-copper oxide ($YBa_2Cu_3O_7$) and the like. The metal oxide films prepared by the present process can be resistive, conductive, and even superconductive depending upon the chemical compositions and microstructures.

The aqueous composition can be deposited on a desired substrate, e.g., by spray coating, dip coating, spin coating, ink jet printing and the like.

After initial deposition of the aqueous composition on a substrate, the composition is treated to obtain a coherent coating, e.g., a stable thin film coating. One manner of treatment can be by initially drying by heating the deposited composition to temperatures of from about 50° C. to about 150° C. for from about 15 minutes to several hours, preferably for less than one hour. Another manner of treatment can simply involve spinning the composition to form a coherent coating.

To obtain a resultant polymer-free metal oxide thin film, the thin film coating must be calcined or heated at high temperatures of from about 250° C. to about 950° C., preferably from about 450° C. to about 850° C. for a period of time sufficient to remove the polymer and leave only the metal oxide thin film.

The deposited polymer-metal oxide thin film undergoes removal of volatile species during the drying stage and structural rearrangement during the calcination stage.

The resultant metal oxide films from the present process have been optical quality films in that they are highly smooth films with a mirror-like appearance. Atomic force microscopy was used to characterize the surface topology of $BaTiO_3$ thin films. The major feature here was that the domain size of these $BaTiO_3$ films is approximately 100 nanometers (nm).

The present invention enables the processing of metal oxide thin films with convenience and flexibility required in industrial fabrication. This process involves making metal oxide thin films from aqueous solutions—an organic solvent-free process. Barium titanate (BTO) thin films have been prepared using polymer-assisted aqueous solution deposition (PASD) techniques. The dielectric properties of these barium titanate thin films have been studied in the frequency region of 100 Hz to 10 MHz. The data show that the barium titanate films prepared by PASD have a dielectric loss of 0.01 in the frequencies ranging from 100 Hz to 10 MHz. Both the dielectric constant and the dielectric loss of these barium titanate thin films are bias voltage dependent and decrease with increasing bias voltage. X-ray diffraction measurement indicates that the barium titanate thin films on silicon substrates are preferentially oriented along the (100) whereas the films on $LaAlO_3$ are pure (110) orientation. Microstructures and surface morphology of the films were also characterized with transmission electron microscopy.

A typical formulation for deposition of BTO includes an aqueous solution containing titanium bis(ammonium lactato) dihydride, barium acetate, and polyvinyl alcohol.

In comparison to organic solvent processing, aqueous solution processing offers versatile manipulation of nanostructures through the introduction of micelles, liquid crystals and supramolecular assemblies. The present invention offers advantages over existing chemical solution technologies. Additionally, the approach of the present invention may be expanded to many or all metal oxides. Also, by modifying the atmosphere during calcination from an oxygen-containing atmosphere to a nitrogen-containing atmosphere, metal nitrides may be formed as well.

The present invention is more particularly described in the following examples which are intended as illustrative only, since numerous modifications and variations will be apparent to those skilled in the art.

EXAMPLE 1

An aqueous titanium metal solution was prepared by adding 6.11 grams (g) of titanium bis(ammonium lactato) dihydride (50 percent by weight of the complex in water) to an aqueous solution of barium acetate prepared by dissolving 2.653 g of barium acetate in a minimal amount of water to form a saturated solution. The titanium metal solution and the barium acetate solution were slowly added to obtain a clear solution with a molar ratio of Ti:Ba of 1:1. The solution was diluted with water to a total volume of 10 milliliters (ml).

A total of 1 g of polyvinyl alcohol was dissolved in 10 ml of water. It was necessary to give the solution sufficient time to completely dissolve (overnight). Optionally, filtration could be used if there are particles or other undissolved solids in the solution. It was found particularly useful to dissolve the polyvinyl alcohol in an excess of water and then concentrate the polymer solution to the desired volume under nitrogen.

The aqueous solution including the metals was mixed with a 10 percent (volume/volume) aqueous solution of the polyvinyl alcohol in a volume ratio of 1:1. The resulting solution was used to spin coat thin films onto substrates of silicon oxide/silicon or lanthanum aluminum oxide ($LaAlO_3$). Spin coating was readily achieved with a spinning, spin of 6000 rpm over 60 seconds. (Spin Coater Model 100, from Cost Effective Equipment, a division of Brewer Science, Inc., Rolla, Mo.)

The composite thin films of polymer and metal were then initially heated to about 150° C. to eliminate any possible remaining volatile species in the films and then calcined at 800° C. for one hour under an oxygen atmosphere. The calcination and annealing process yielded optical quality (mirror-like) thin metal oxide films on $LaAlO_3$ a substrate with pure (100) orientation.

EXAMPLE 2

A ruthenium oxide film was prepared as follows. A ruthenium metal-oxide solution was prepared by initially concentrating a dilute solution of ruthenium (III) nitrosyl nitrate (available from Aldrich Chemical Co.) in dilute nitric acid (a ruthenium concentration of 1.5 weight percent). The concentration procedure was carried out in a hood by blowing nitrogen over the aqueous solution of ruthenium (III). The desirable final concentration of ruthenium was typically around 20 percent by weight and the evaporation of water was stopped at this concentration.

Then, the concentrated ruthenium solution was mixed with a poly(vinyl alcohol) solution to yield the sired viscosity. Typical concentrations of such poly(vinyl alcohol) solutions were about 10 percent by weight and they were mixed with the ruthenium solution at various ratios as shown in Table 1.

TABLE 1

| Sample Number | $Ru(NO)(NO_3)_x(OH)_y$ (mg) | PVA (mg) | $RuO_2$ (mg) | Room Temperature Conductivity ($\mu\Omega$.cm) | $RuO_2$: PVA Ratio |
|---|---|---|---|---|---|
| 1 | 43.6 | 2.87 | 30.0 | — | 10.5 |
| 2 | 42.6 | 8 | 29.4 | 959 | 3.675 |
| 3 | 43.6 | 15.9 | 30.0 | 632 | 1.89 |
| 4 | 43.0 | 30.4 | 29.6 | 779 | 0.97 |
| 5 | 42.4 | 45.8 | 29.2 | 3637 | 0.64 |
| 6 | 48.0 | 124.1 | 33.0 | 2295 | 0.27 |

The homogeneous polymer-metal complex solutions were spun coated onto substrates such quartz and silicon wafers. The spin speed was typically about 6000 revolutions per minute (rpm). The substrates coated with the polymer-metal composite films were then calcined at about 600° C. for about 2 hours to yield the final ceramic films.

EXAMPLE 3

A free-standing ruthenium oxide film was prepared as follows. An aqueous ruthenium (III) nitrosyl nitrate solution containing 10 percent by weight ruthenium was mixed with an aqueous poly(vinyl alcohol) solution containing 10 percent by weight PVA at a weight ratio of 1:1 to yield a transparent metal-polymer solution. Metal-polymer composite films were obtained by spin coating this solution onto thin glass substrates at a spinning speed of 6000 rpm. The substrates were then heated to 300° C. and maintained at this temperature for around 10 minutes to immobilize the metal-polymer materials. The coated substrates were then re-spun while applying the same solution to obtain thicker films. The process was repeated ten times in order to accumulate enough materials for free-starting metal-oxide films.

The substrates coated with multiple layers of the metal-polymer films were heat treated at 550° C. for three hours to yield metallic conductive ruthenium oxide films. To remove the silica substrates, ruthenium oxide samples were dipped in a 5 percent by weight hydrofluoric acid solution for ten hours. After the glass reacted completely with the HF, free-standing ruthenium oxide films were obtained.

EXAMPLE 4

Two types of magnesium oxide solutions were prepared. First, an aqueous solution of $Mg(NO_3)_2$ containing 1.2 to 5 percent by weight of magnesium and PVA (10 percent by weight) were mixed at a solution weight ratio of 1:9 to 1:2. Second, an aqueous solution of magnesium acetate, tetrahydrate $C_4H_6O_4Mg$ with 4 $H_2O$ (5.3 weight percent of magnesium) and PVA (10 percent by weight) were mixed at a solution weight ratio of 1:2. Thin metal-polymer composite films were obtained by spin coating this solution onto various substrates at a spinning speed of 6000 rpm. On glass substrates, the resulting metal-polymer composites were heated to 550° C. for around 3 hours to obtain magnesium oxide films. On silicon or gold substrates, the resulting metal-polymer composites were heated to 550° C. for around 3 hours, then at 800° C. for two hours to obtain magnesium oxide films.

EXAMPLE 5

In a dry box, 2.0829 grams of strontium acetate was weighed out. The strontium acetate was dissolved in 6 ml of water and added to a mixture of 5.956 g of titanium bis(ammonium lactato) dihydride (50 percent by weight of the complex in water) and about 10 ml of PVA solution (10 percent by weight of PVA). Applying this solution to various substrates with spin coating at 6000 rpm over about 30 seconds resulted in a metal-polymer composite film. Subsequent heating of this film at 800° C. for two hours converted the metal-polymer composite film to a ceramic strontium titanate film.

EXAMPLE 6

Barium nitrate (0.9 g) was dissolved in 10 ml of deionized water. Separately, yttrium nitrate (0.5849 g) was dissolved in 10 ml of deionized water. To the yttrium nitrate solution was added 1.2026 g of copper nitrate. The barium nitrate and the yttrium/copper nitrate solution mixture were then combined and mixed with an equal volume of an aqueous PVA solution (10 percent by weight of the PVA). Applying this solution to various substrates with spin coating at 6000 rpm over about 30 seconds resulted in a metal-polymer composite film. Subsequent heating of this film at 800° C. for two hours converted the metal-polymer composite film to a ceramic yttrium-barium-copper oxide film.

Examples 1 through 6 demonstrate that metal oxide films can be formed in the process of the present invention including a water-soluble polymer.

EXAMPLE 7

To a mixture of ruthenium (III) nitrosyl nitrate aqueous solution containing 10 percent by weight ruthenium and an aqueous poly(vinyl alcohol) solution containing 10 percent by weight PVA was added a colloidal silica solution (DMAC-St available from Nissan Chemical Industries) in N,N-dimethyl acetoamide (20 weight percent $SiO_2$). The particle size of the silica colloid was from about 10 to about 20 nanometers (nm). The weight ratio of Ru:PVA:nanoparticles was maintained at 2:4:1. The metal-polymer-colloid composite films were obtained by spin coating this solution onto thin glass substrates at a spinning speed of 6000 rpm. The substrates were then heated to 300° C. and maintained at this temperature for around 10 minutes to immobilize the metal-polymer-silica materials. The coated substrates were then re-spun while applying the same solution to obtain thicker films. The process was repeated ten times in order to accumulate enough materials for free-starting metal-oxide films.

The substrates coated with multiple layers of the metal-polymer-colloid films were heat treated at 550° C. for three hours to yield metallic conductive ruthenium oxide films with silica nanoparticles dispersed therein. To remove the silica nanoparticles and substrates, ruthenium oxide samples were dipped in a 5 percent by weight hydrofluoric acid solution for ten hours. After the silica reacted completely with the HF, free-standing mesoporous ruthenium oxide films were obtained.

EXAMPLE 8

To a ruthenium (III) nitrosyl nitrate aqueous solution containing 10 percent by weight ruthenium was added colloidal silica (MA-ST-UP available from Nissan Chemical Industries) in methanol (20 weight percent $SiO_2$). The particle size of the silica colloid was elongated with a width of from about 5 to about 20 nm and a length of from about 40 to 300 nm. The weight ratio of Ru:nanoparticles was maintained at 1:2. The metal-colloid composite films were obtained by spin coating this solution onto thin glass substrates at a spinning speed of 6000 rpm. The substrates were then heated to 300° C. and maintained at this temperature for around 10 minutes to immobilize the metal-polymer-silica materials. The coated substrates were then re-spun while applying the same solution to obtain thicker films. The process was repeated ten times in order to accumulate enough materials for free-starting metal-oxide films.

The substrates coated with multiple layers of the metal-colloid films were heat treated at 550° C. for three hours to yield metallic conductive ruthenium oxide films with silica nanoparticles dispersed therein. To remove the silica nanoparticles and substrates, ruthenium oxide samples were dipped in a 5 percent by weight hydrofluoric acid solution for ten hours. After the silica reacted completely with the HF, free-standing mesoporous ruthenium oxide films were obtained.

EXAMPLE 9

Titanium (IV) bis(ammonium lactato)- dihydroxide (1 percent by weight of titanium) and a polymer latex (5 percent by weight of poly(butyl acrylate-co-styrene-co-acrylic acid) with a particle size of about 70 nm). Thin metal-polymer composite films were obtained by spin coating this solution onto various substrates at a spinning speed of 3000 rpm. The substrates were then heated to 600° C. for around 3 hours to obtain titanium oxide films.

Examples 7 through 9 demonstrate that metal oxide films can be formed in the process of the present invention including other materials for control of solution viscosity.

Although the present invention has been described with reference to specific details, it is not intended that such details should be regarded as limitations upon the scope of the invention, except as and to the extent that they are included in the accompanying claims.

What is claimed is:

1. A process of preparing a free-standing ruthenium oxide film comprising:

applying an aqueous solution including a water-soluble polymer and a water-soluble ruthenium precursor onto a silica substrate to form a polymer and ruthenium containing layer thereon;

treating said substrate including said polymer and ruthenium containing layer for a time to form a coherent inorganic-organic composite film;

heating said substrate in an oxygen-containing atmosphere at temperatures characterized as sufficient to remove said polymer from said inorganic-organic composite film; and, contacting said silica substrate with a solution of hydrofluoric acid to form said free-standing ruthenium oxide film.

2. The process of claim 1 wherein said free-standing ruthenium oxide film is a mesoporous free-standing ruthenium oxide film formed by including colloidal silica in said aqueous solution and following removal of said polymer from said inorganic-organic composite film by the additional step of contacting said substrate with a solution of hydrofluoric acid.

3. A process of preparing a mesoporous ruthenium oxide film comprising:

applying an aqueous solution including a water-soluble polymer, a water-soluble ruthenium precursor and colloidal silica onto a substrate to form a polymer and ruthenium containing layer thereon;

treating said substrate including said polymer and ruthenium containing layer for a time to form a coherent inorganic-organic composite film;

heating said substrate in an oxygen-containing atmosphere at temperatures characterized as sufficient to remove said polymer from said inorganic-organic composite film; and, contacting said colloidal silica with a solution of hydrofluoric acid to form said mesoporous ruthenium oxide film.

* * * * *